US009764866B2

(12) United States Patent
Schiavina

(10) Patent No.: US 9,764,866 B2
(45) Date of Patent: Sep. 19, 2017

(54) DEVICE FOR CYCLIC SPREADING OF TRAY SEALING FILM IN SEALING MACHINES

(71) Applicant: GRUPPO FABBRI VIGNOLA S.P.A., Vignola (IT)

(72) Inventor: Andrea Schiavina, Correggio (IT)

(73) Assignee: GRUPPO FABBRI VIGNOLA S.P.A., Vignola (IT)

( * ) Notice: Subject to any disclaimer, the term of this patent is extended or adjusted under 35 U.S.C. 154(b) by 386 days.

(21) Appl. No.: 14/402,804

(22) PCT Filed: May 17, 2013

(86) PCT No.: PCT/EP2013/060240
§ 371 (c)(1),
(2) Date: Nov. 21, 2014

(87) PCT Pub. No.: WO2013/174746
PCT Pub. Date: Nov. 28, 2013

(65) Prior Publication Data

US 2015/0107191 A1 Apr. 23, 2015

(30) Foreign Application Priority Data

May 24, 2012 (IT) ..... BO2012A0283

(51) Int. Cl.
*B65B 3/00* (2006.01)
*B65B 7/16* (2006.01)
(Continued)

(52) U.S. Cl.
CPC ..... *B65B 7/162* (2013.01); *B65B 31/028* (2013.01); *B65B 51/10* (2013.01)

(58) Field of Classification Search
CPC ..... B29C 66/8161; B65B 7/164
(Continued)

(56) References Cited

U.S. PATENT DOCUMENTS 6,282,866 B1 * 9/2001 Natterer ..... B65B 7/164 198/833
2004/0098947 A1 5/2004 Konishi
(Continued)

FOREIGN PATENT DOCUMENTS

DE 102007021517 8/2008
EP 1038773 9/2000

OTHER PUBLICATIONS

International Search Report and Written Opinion for International Application No. PCT/EP2013/060240; Jul. 10, 2013; 6 pages.

*Primary Examiner* — Hemant M Desai
*Assistant Examiner* — Eyamindae Jallow
(74) *Attorney, Agent, or Firm* — Stetina Brunda Garred and Brucker

(57) ABSTRACT

A device for spreading the tray sealing film in so-called tray sealers, in order to avoid the formation of folds in said film which, with the trays, is inserted in a sealing and cutting station, between a pair of opposing bells provided with a relative reciprocal approaching and distancing movement, where downstream of said station means are provided to subject the off-cut of film which exits to a transversal stretching action which ensures correct spreading of said film between said bells, characterized by comprising means for braking the film upstream of said station and comprising pincer means with a jaw mounted on the side of the upper bell from which the film exits, turned downwards and vertically opposing a corresponding jaw mounted on the lower bell, all being envisaged to ensure that in the reciprocal approach and closure step of the two bells, before the film is gripped and blocked between them, longitudinal and lateral portions of the film which are close to the bells are pincered between said opposing pairs of jaws of said pincers, which firmly grip the film, also due to the presence of counter springs and friction sliding blocks and which, due to
(Continued)

an inclines and divergent position of them with respect to the direction of advance of the film, subject said film to transversal or preferably transversal and longitudinal stretching, in the same direction of advance indicated above, to spread the film between the bells before their closure on said film.

5 Claims, 1 Drawing Sheet

(51) Int. Cl.
*B65B 31/02* (2006.01)
*B65B 51/10* (2006.01)

(58) Field of Classification Search
USPC ..... 53/266.1, 284.1, 285, 329, 329.3, 329.5, 53/442, 447
See application file for complete search history.

(56) References Cited

U.S. PATENT DOCUMENTS

2004/0206048 A1* 10/2004 Iuchi ..... B29C 65/18 53/329.2
2006/0048480 A1* 3/2006 Konishi ..... B65B 7/164 53/329.3

* cited by examiner

DEVICE FOR CYCLIC SPREADING OF TRAY SEALING FILM IN SEALING MACHINES

CROSS REFERENCE TO RELATED APPLICATIONS

The present application claims priority to PCT International Application No. PCT/EP2013/060240 filed on May 17, 2013, which claims priority to Italian Patent Application No. B02012A000283 filed May 24, 2012, the entirety of the disclosures of which are expressly incorporated herein by reference.

STATEMENT RE: FEDERALLY SPONSORED RESEARCH/DEVELOPMENT

Not Applicable.

BACKGROUND OF THE INVENTION

The invention relates to the so-called tray sealers, i.e. machines which seal with a covering film tubs or trays filled with a product to be packaged, such as a food product. The document cited as the closest prior art to this invention is the published U.S. patent application No. US 2004/098947, which envisages placing downstream of the sealing and cutting station a pair of complementary-shaped rollers which are used to pincer the longitudinal edges of the film exiting from said station, which are divergent to each other in the direction of advance of said film and which are mounted on freely stepped wheels, so as to allow solely advance of said film. This solution is problematic, since it requires a specific action of insertion of the edges of the film between said rollers and subjects the film substantially to a single transversal stretching action, entirely equivalent to the one performed by said spreader roller.

Also cited as the prior art documents are EP 1 038 773 of 27 Sep. 2000, and DE 10 2007 021517 of 14 Aug. 2008.

SUMMARY OF THE INVENTION

In particular, the invention may be applied at a sealing station of these machines, usually provided with a lower and horizontal bell, with openings into which pincers insert trays full of the product, and provided with an upper and usually static bell, beneath which transits a thermoplastic film coming from a supply reel positioned above and at one end of the bell and connected to a collection beam positioned above and at the other end of said upper bell, inside which heat-sealing and cutting means are provided which, after raising of the lower bell, respectively close each tray with a portion of interposed film and which then cut the perimeter of said portion of sealing film of each tray, so that when the lower bell descends, the trays closed with heat-sealed film remain inside it and, by means of extractors, are placed in a raised position for gripping by a section of the pincer means which, while performing said supply step, transfer the closed trays from said closing station to a subsequent offloading station. The off-cut of the section of film beneath the upper bell is advanced cyclically so as to be carried towards the collection means downstream and to be replaced by a new section of intact film coming from the supply means upstream. While upstream of the upper bell, the film coming from the supply reel may be returned onto a normal idle and straight roller, downstream of said bell the film is usually returned onto a roller or spreading guide, the so-called spreader, usually arched and convex in shape, which spreads the film with which it is in contact, so that this is positioned beneath the upper bell well spread and with no folds or creases. This solution only gives the desired results if the film is advanced until it touches the spreader with an uncut section of it, i.e. until the entire off-cut is transferred downstream of the spreader and this leads to a large amount of waste of the film between successive functioning cycles of the tray sealer.

These documents do not suggest how it is possible to solve the technical problem at the basis of the invention, reducing consumption of the film in the tray sealers, reducing to the minimum possible advance of said film between the subsequent cycles of these machines, even if the off-cut of film remains in cooperation with the spreader, with a device according to claim 1 and the subsequent dependent claims, which envisages downstream heat-sealing and cutting bells, pincer means which, in step with closure of said bells, close on the longitudinal edges of the film just downstream of said bells, to stretch it and preferably also to elongate it, with a transversal and preferably also a longitudinal component, of a sufficient magnitude to ensure correct spreading of the section of film between said bells, before they close and grip said film. According to a preferred embodiment, the components of the two pincers are mounted on two bells or in any manner such as to exploit the relative opening and closing movement of said bells on the film, with a considerable simplification of construction and with major functioning reliability of the device.

BRIEF DESCRIPTION OF THE DRAWINGS

Further characteristics and advantages of the invention will become more apparent from the following description of a preferred embodiment, illustrated by way of a non-limiting example in the figures in the single table appended to the drawings, wherein.

DETAILED DESCRIPTION OF THE INVENTION

Figure 1:
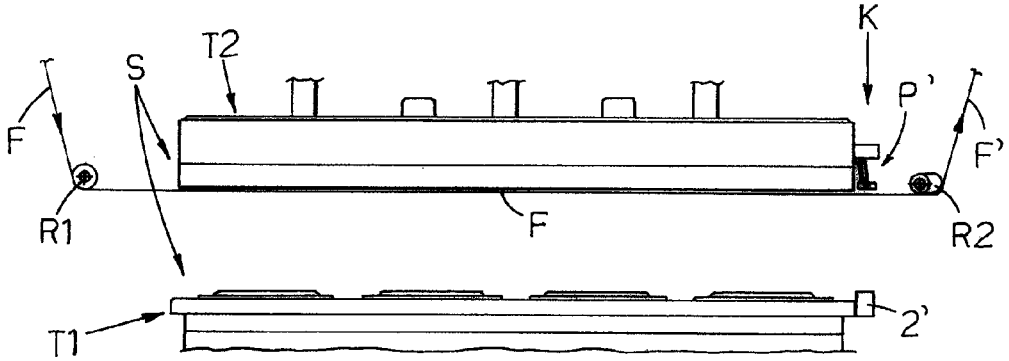
FIG. 1 is a schematic and lateral view of the sealing and cutting station of the tray coverage film, in the open and idle position, with the path of the film and with the spreading devices according to the invention applied.
Figure 2:
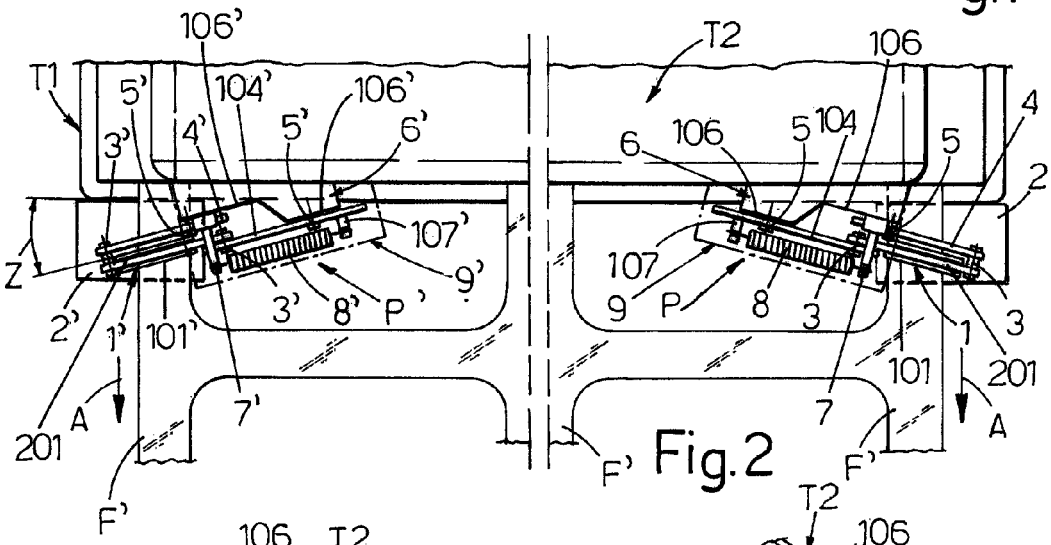
FIG. 2 illustrates in a bird's eye view, as indicated by arrow K in FIG. 1, the exit face of the sealing and cutting station, with the spreading devices according to the invention applied.
Figure 4:
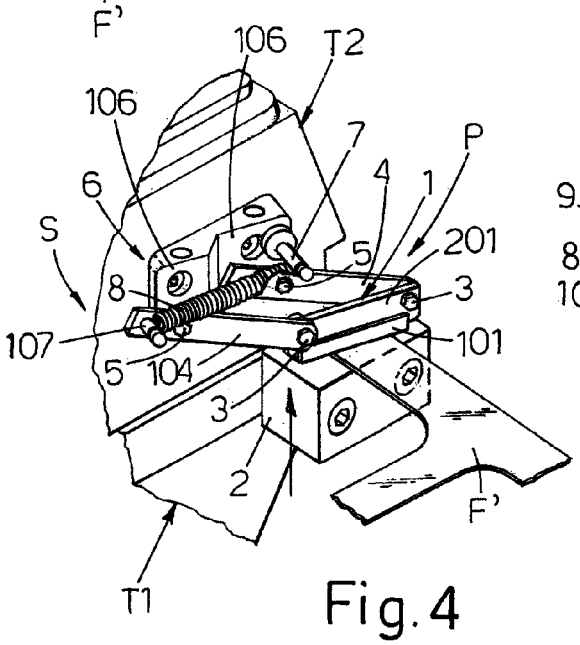
FIGS. 3 and 4 are perspective views of the spreading device positioned on the right side of the station of FIG. 2 and shown respectively in an initial phase and in the final phase of its work cycle.
Figure 3:
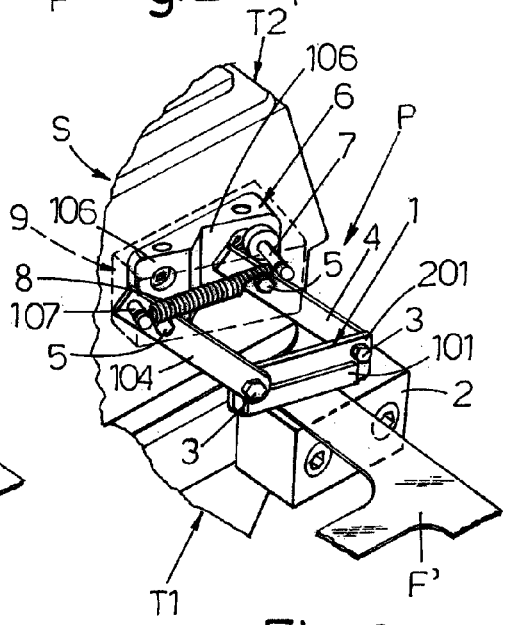

In FIG. 1, the letter S denotes the sealing and cutting station of a tray sealer, with the lower bell T1 on which pincer means (not shown) cyclically position an ordered set of trays (also not shown), and which in the idle position is lowered and duly distanced from an upper bell T2 which, as said, contains the sealing and cutting means, which is mounted statically on a supporting frame and beneath which film F transits and is arranged at a short distance, coming from the left, from a supply reel (not shown) and from return onto an idle roller R1, and which, on the right of station S, is returned onto the spreader roller R2 and which, in the form of off-cut F', is connected to a collection beam (also not shown). The lower bell T1 is mounted on raising and lowering means and, after being loaded with trays, it is lifted to house said trays in their own slots and to close package-style beneath bell T2, gripping the interposed section of film F, which is sealed and cut around the perimeter of each tray, so that, in the subsequent lowering run of the lower bell T1, the closed trays are lifted by extractors and made to protrude above said bell T1, in the correct condition for gripping and evacuation to the right, while the new trays arrive from the left, for repetition of a new work cycle. Bells T1 and T2 are often arranged to introduce conservation gases inside the trays, before their closure, according to known solutions which are not considered here since they are unconnected with and unnecessary for understanding the invention. During lowering of the lower bell T1, film F is advanced to the right if facing FIG. 1, to provide a new uncut section beneath upper bell T2, while the removed and off-cut section of film F', produced in the previous work cycle, exits from the right face of said bell T2 and is collected by the specific means. To ensure that the film is correctly positioned beneath upper bell T2, without a section of uncut film reaching the spreader roller R2, in order to achieve the purposes of inexpensiveness stated in the introduction of this description, the invention envisages positioning on the right face of station S, the one of cyclic exit of the film, pincer means P and P' (FIG. 2) which, in correct phase with the raising run of bell T1, before this closes the film F between itself and upper bell T2, grip the outer and longitudinal sides of the film F or the off-cut F' exiting from station S and subject it to slight spreading in both the transversal and longitudinal direction, towards the right if facing FIG. 1, whereas the film itself is appropriately braked upstream by known means, for example associated with the supply reel. This condition is sufficient to ensure that the section of film between the bells T1 and T2 is perfectly spread and seals firmly onto the trays, including those positioned on the right of station S, without forming unsightly folds which could create faulty seals and trays which are not perfectly hermetically sealed by said film. According to a preferred embodiment of the invention, said pincer means P, P' are realised by associating with one of the bells, for example static and upper bell T2, respective oscillating and sprung jaws 1, 1', coated with a material with a high friction coefficient with respect to the film F, F', towards which they are directed in an oblique arrangement (see below) and from which they are duly raised to avoid undesired interference. Opposing said jaws 1, 1' and in substantial and vertical alignment with them, on the right face of lower bell T1, jaws 2, 2' are positioned, having a low friction coefficient with respect to said film F, F' and such that when bell T1 is raised, before the film is closed between bells T1 and T2, the lower jaws 2, 2' touch the corresponding portions of the sides of the film and bring them into contact with the upper jaws 1, 1' while, while changing their height, as a result of raising of T1 and jaws 2, 2', adhering by means of friction to said side portions of the film, cause them to slide on the flat and parallel face of lower jaws 2, 2', subjecting the film immediately upon exit from the bells to that small composite transversal and longitudinal spreading movement, useful for achieving the purposes indicated above. The details of FIGS. 2 and 3 show how the upper jaw 1 of pincer P is formed of the lower coating in elastomer material 101 of a metal strap 201 in a shearing position and which with the ends is divided into 3 at the ends of parallel levers 4, 104, in turn with the fulcrum in 5, with an arrangement like a divided parallelogram. on the parallel faces 106 of a support 6 which forms the fourth side of the parallelogram and which is fixed on the right face of bell T2, with an arrangement such that the entire parallelogram and with it the lower jaw 1, are directed towards the outside of the film and arranged obliquely with respect to said film F or F', with inclination Z, for example, of around 15° with respect to the face of bell T2. At the upper end of the internal parallel lever 104, the end of a helical spring 8 is anchored in 107, anchored with the other end to a pin 7 fixed to support 6 and against which the upper section of the external lever 4 strikes when jaw 1 is in the lowered idle position, as shown in FIGS. 1 and 3. The components of the other upper jaw 1' are the same as those of jaw 1 and are indicated with the word "first". When the lower bell T1 rises and raises the lower jaws 2, 2', realised simply with small sliding blocks in Polizene® or in another equivalent material, the upper and flat face of said jaws 2, 2' brings the side of the film against the upper jaws 1, 1' and raises them in contrast with the action of the springs 8, 8'. The active parts 101, 101' of the upper jaws 1, 1' adhere to film F, F' by means of friction and the return action of the springs 8, 8', while the film slides on the lower jaws 2, 2', so that on closure and gradual raising of the jaws of the pincers P, P', thanks to said oblique positioning Z of the upper jaws 1, 1', these move simultaneously towards the outside and in direction A of advance of the film, as shown in FIG. 4, subjecting the front section of said film to the double and simultaneous transversal and longitudinal spreading indicated above, before said film is blocked between bells T1 and T2.

On lowering of bell T1, the device returns automatically into the idle position of non-interference with film F or F' which may thus be advanced in direction A of FIG. 2, for repetition of a new work cycle. It is understood that positioning of the two jaws on bells T1 and T2 may be inverted with respect to what is illustrated, even if this is a preferred embodiment, since positioning of the mobile jaw above, in association with the static and upper bell T2, makes this position more protected and safer. It may be seen from FIGS. 2 and 3 that the upper part of the mechanism with the support 6, 6' and with the spring 8, 8' may be covered with a small removable covering 9, 9', fixed for example with screws to said supports 6, 6' and open downwards. It is also understood that similar pincers to those described may also be arranged on the left face of the bells T1 and T2, from which film F enters. It is also understood that the description relates to a preferred embodiment of the invention, to which numerous construction variants may be made without deviating from the principle of the invention, as described, illustrated and indicated in the following claims.

What is claimed is:

1. A device for spreading the sealing film of trays in the so-called tray sealers, in order to avoid the formation of folds in said film (F), which with the trays is inserted in a sealing and cutting station (S), between an opposing pair of bells (T1, T2) provided with a relative reciprocal approaching and distancing movement, wherein downstream of said station (S), means are provided to submit the off-cut of film which emerges to a transversal stretching which ensures correct spreading of the film between said bells and which comprises means for braking the film upstream of said station (S), characterised by comprising pincer means (P, P') with a jaw (1, 1') mounted on or at the face of the upper bell (T2) from which the film exists, turned downwards and vertically opposing a corresponding jaw (2, 2') mounted on the lower bell (T1), all to ensure that in the reciprocal approaching and closure step of the two bells (T1, T2), before the film is gripped and blocked between them, longitudinal and lateral portions of the film (F, F') close to the bells are pincered between said opposing pairs of jaws (1, 2, 1', 2') which grip the film also due to the presence of counter springs (8, 8') and friction sliding blocks (101, 101')

and which, due to their shape and position and their reciprocal mobility, subject the film to transversal spreading, before the bells (T1, T2) close on said film, characterised by one of the jaws (1, 1') of said spreading pincers (P, P'), for example the one mounted on the upper bell (T2), being formed of a coating in elastomer material (101, 101') of a metal strap (201, 201') which, with the ends, is divided at the ends (3, 3') of parallel levers (4, 104, 4', 104') which in turn have their fulcrum in a parallelogram arrangement divided, on the fulcrums (5, 5'), carried by the parallel faces (106, 106') of a support (6, 6') which forms the fourth side of the parallelogram and which is fixed on the face of the bell (T2), with an arrangement wherein the entire parallelogram and with it the lower jaw (1, 1') are turned towards the outside of the film and arranged obliquely with respect to said film (F, F'), with a sufficient inclination (Z) with respect to said bell (T2), being at the upper end (107, 107') of one of said parallel levers (104, 104'), the end of an elastic means (8, 8') being anchored with the other end to a pin (7, 7') fixed to said support (6, 6') and against which the upper section of the other parallel lever (4, 4') strikes when the jaw (1, 1') is in the lowered idle position and of maximum spreading downwards, while the other jaw (2, 2') fixed to the lower bell (T1) is formed of a sliding block fixed to said bell, in a material with a low friction coefficient with respect to the film, provided with at least one upper flat face parallel to said upper jaw (1, 1'), so that when the pincers (P, P') close on the film, this cooperates in friction with said upper jaws and, in contrast, may slide on the lower jaws.

2. The device according to claim 1, wherein said pincers (P, P'), viewed from above, have an inclined positioning (Z) which sees them diverge from each other in direction (A) of advance of the film, so that when said pincers close in the reciprocal approach step of said bells (T1, T2), they subject said film to both transversal and longitudinal stretching in the same direction of advance (A) indicated above.

3. The device according to claim 2, wherein said inclination (Z) of the upper jaws (1, 1') is approximately 15°.

4. The device according to claim 1, wherein the upper jaws (1, 1') are positioned so that in their idle position they do not interfere with the film (F), which may slide freely beneath them and beneath the upper bell (T2) which carries them.

5. The device according to claim 1, wherein the part with counter springs (8, 8') of the mobile jaws (1, 1') is protected by a removable covering (9, 9').

* * * * *